US012420163B2

(12) United States Patent
Nock

(10) Patent No.: US 12,420,163 B2
(45) Date of Patent: Sep. 23, 2025

(54) CARRIER STRAPS FOR WEIGHT PLATES

(71) Applicant: Steven Nock, Henrico, VA (US)

(72) Inventor: Steven Nock, Henrico, VA (US)

( * ) Notice: Subject to any disclaimer, the term of this patent is extended or adjusted under 35 U.S.C. 154(b) by 0 days.

(21) Appl. No.: 18/506,348

(22) Filed: Nov. 10, 2023

(65) Prior Publication Data

US 2024/0075373 A1 Mar. 7, 2024

Related U.S. Application Data

(63) Continuation of application No. 17/407,727, filed on Aug. 20, 2021, now Pat. No. 11,850,495.

(60) Provisional application No. 63/069,099, filed on Aug. 23, 2020.

(51) Int. Cl.
*A63B 71/00* (2006.01)
*A63B 21/072* (2006.01)

(52) U.S. Cl.
CPC ..... *A63B 71/0036* (2013.01); *A63B 21/072* (2013.01)

(58) Field of Classification Search
CPC ..... A63B 21/06–08
See application file for complete search history.

(56) References Cited

U.S. PATENT DOCUMENTS 2,118,114 A 5/1938 Schenk
3,219,342 A 11/1965 Melchiona
4,023,808 A * 5/1977 Hebert ..... A63B 21/0004 482/126
4,681,315 A 7/1987 Yang
4,852,874 A * 8/1989 Sleichter, III .... A63B 21/00185 482/122
4,909,505 A * 3/1990 Tee ..... A63B 21/0552 482/121
4,911,439 A 3/1990 Kuhl
5,090,691 A * 2/1992 Pollock ..... A63B 21/4035 248/693
5,518,481 A 5/1996 Darkwah
5,614,300 A * 3/1997 Cicali ..... A63B 21/0552 482/902
5,620,397 A 4/1997 Chieh
5,727,833 A 3/1998 Coe
6,447,037 B1 * 9/2002 Crouch ..... B65D 33/14 294/149
6,672,997 B1 1/2004 Winkler
7,044,894 B1 5/2006 Smith
7,652,953 B1 1/2010 Fluegge
7,931,572 B1 * 4/2011 Glauser ..... A63B 21/0004 482/126

(Continued)

*Primary Examiner* — Nyca T Nguyen
(74) *Attorney, Agent, or Firm* — Rothwell, Figg, Ernst & Manbeck, P.C.

(57) ABSTRACT

Disclosed is a compact, convenient carrier system for weight plates. The carrier system includes a strap, a carrying handle, and rigid loading bar. Preferably, the loading bar is a tubular member. Preferably, the carrying handle has an outer diameter that permits the carrying handle to be slidably disposed within the inner diameter of the loading bar. Preferably, the loading bar has an outer diameter that permits the loading bar to fit within the central opening on a standard Olympic weightlifting weight plate. The carrier system optionally provides a clip closure attached to the strap that allows easy opening and closing of the system.

18 Claims, 5 Drawing Sheets

(56) References Cited

U.S. PATENT DOCUMENTS

| | | | | |
|---|---|---|---|---|
| 7,998,034 | B1 * | 8/2011 | Cobo | A63B 21/4019 482/126 |
| 8,012,071 | B2 | 9/2011 | Grisdale | |
| D678,434 | S * | 3/2013 | Hughes | D21/692 |
| 8,894,556 | B2 * | 11/2014 | Webb | A63B 21/075 482/126 |
| 9,504,867 | B2 * | 11/2016 | Hall | A63B 21/0722 |
| 9,592,418 | B2 * | 3/2017 | Burrell | A63B 21/00043 |
| 9,635,925 | B2 | 5/2017 | Moreau | |
| 9,868,013 | B1 | 1/2018 | Leverenz | |
| 10,384,094 | B1 * | 8/2019 | Newman | A63B 21/0557 |
| 10,398,923 | B2 * | 9/2019 | Hur | A63B 21/0552 |
| 10,610,760 | B2 | 4/2020 | Nowlan | |
| 10,695,603 | B1 | 6/2020 | Lamping | |
| 10,912,374 | B2 * | 2/2021 | Hopple | A45F 5/1046 |
| 11,033,774 | B1 | 6/2021 | Clarke | |
| 11,400,334 | B2 | 8/2022 | Hetrick | |
| 11,497,259 | B1 | 11/2022 | Womack | |
| 2004/0067827 | A1 * | 4/2004 | Tustin | A63B 21/0552 482/121 |
| 2006/0160679 | A1 * | 7/2006 | Kung | A63B 21/0004 482/121 |
| 2007/0225134 | A1 | 9/2007 | Slattery | |
| 2012/0108403 | A1 | 5/2012 | Zandman-Zeman | |
| 2013/0212898 | A1 * | 8/2013 | Reynolds | A45C 13/30 34/239 |
| 2013/0316880 | A1 * | 11/2013 | Bosse | A63B 21/0728 482/107 |
| 2014/0228180 | A1 | 8/2014 | Walker | |
| 2015/0024908 | A1 | 1/2015 | Hall | |
| 2015/0136825 | A1 * | 5/2015 | Kalck | A63B 55/408 224/653 |
| 2015/0141217 | A1 | 5/2015 | Young | |
| 2015/0297937 | A1 * | 10/2015 | Burkinshaw | A63B 21/068 482/139 |
| 2016/0095420 | A1 | 4/2016 | Moreau | |
| 2016/0095421 | A1 | 4/2016 | Moreau | |
| 2017/0021219 | A1 | 1/2017 | Kelly | |
| 2017/0050065 | A1 * | 2/2017 | Carter | A63B 21/16 |
| 2017/0127814 | A1 | 5/2017 | Mundy | |
| 2018/0185692 | A1 | 7/2018 | Wailes | |
| 2019/0060696 | A1 | 2/2019 | Moore | |
| 2019/0314666 | A1 | 10/2019 | Mantione | |
| 2020/0023228 | A1 | 1/2020 | Yang | |
| 2020/0078628 | A1 | 3/2020 | Parise | |
| 2020/0086162 | A1 | 3/2020 | Garcia | |
| 2020/0114208 | A1 * | 4/2020 | Lessans | A63B 31/00 |
| 2020/0164244 | A1 * | 5/2020 | Gilmore | A63B 21/151 |
| 2021/0178216 | A1 | 6/2021 | Ducato | |
| 2022/0212073 | A1 | 7/2022 | McCuaig | |

* cited by examiner

CARRIER STRAPS FOR WEIGHT PLATES

CROSS-REFERENCE TO RELATED APPLICATIONS

This application is a continuation of U.S. Ser. No. 17/407,727 filed Aug. 20, 2021, which claims the benefit of U.S. Provisional Patent Application No. 63/069,099, filed Aug. 23, 2020, which is hereby incorporated by reference in its entirety.

BACKGROUND

Weightlifting is a popular physical activity. Standard weight plates are typically loaded onto metal barbells for exercises such as bench press, squats, Olympic lifting, and the like. Such plates may be made of metal such as iron or steel, or may be "bumper plates" such as those made of dense rubber for Olympic lifting and similar activities. The plates have a circular opening in the middle that allows the plate to be loaded onto a standard barbell. Rubber bumper plates typically, but not always, have a metal collar around the center opening to provide strength and to facilitate loading onto the bar. Weight plates are made in standardized weights, such as 15, 25, 35, and 45 pound plates, or 5, 10, 15, and 20 kilogram plates. Weight plates are generally flat cylinders, but may vary in circumference and thickness depending on the material from which they are constructed (e.g., metal or rubber) and depending on the manufacturer.

There is a need for an improved and convenient system for carrying standard weight plates.

SUMMARY

The following description presents a simplified summary in order to provide a basic understanding of some aspects described herein. This summary is not an extensive overview of the claimed subject matter. It is intended to neither identify key or critical elements of the claimed subject matter nor delineate the scope thereof.

In some embodiments, a system may allow multiple standard weight plates to be moved from one location to another. An exemplary carrier system may be used for exercise, or for transportation of the weight plates. For example, the carrier system may be used for farmer's carry exercises, in which the user carries weights at his or her side while walking or jogging. The system also may be used for exercises such as curls or rows in which the user repeatedly lifts the weights from the floor to a predetermined location.

In some embodiments, a system may eliminate the need for specialized equipment such as kettlebells or dumbbells to perform such exercises. Kettlebells and dumbbells are disadvantageous in that they are typically sold in pre-set weights such that a large number of pieces of equipment are needed to accommodate different exercises and different users. By contrast, embodiments of the systems described herein may allow the user to adjust weights using standard weight plates that can also be used for barbell exercises. The present systems may also conveniently allow for moving multiple weight plates at a time from one location to another, such as when moving equipment to an outdoor space for use, moving weights into a vehicle, or moving gym equipment to a new location.

In some embodiments, a system for carrying weight plates may include one or more of a first tubular member, a second tubular member, and a strap. The strap may be disposed axially through an interior of the first tubular member and an interior of the second tubular member. In some embodiments, the strap may have a first end and a second end. The first end of the strap may be terminated with a fastener.

Further variations encompassed within the systems and methods are described in the detailed description of the invention below.

BRIEF DESCRIPTION OF THE DRAWINGS

The accompanying drawings, which are incorporated herein and form part of the specification, illustrate various, non-limiting embodiments of the present invention. In the drawings, like reference numbers indicate identical or functionally similar elements.

FIG. 1(*b*) illustrates an exemplary embodiment of the carrier system in the closed position.

DETAILED DESCRIPTION

Figure 1A:
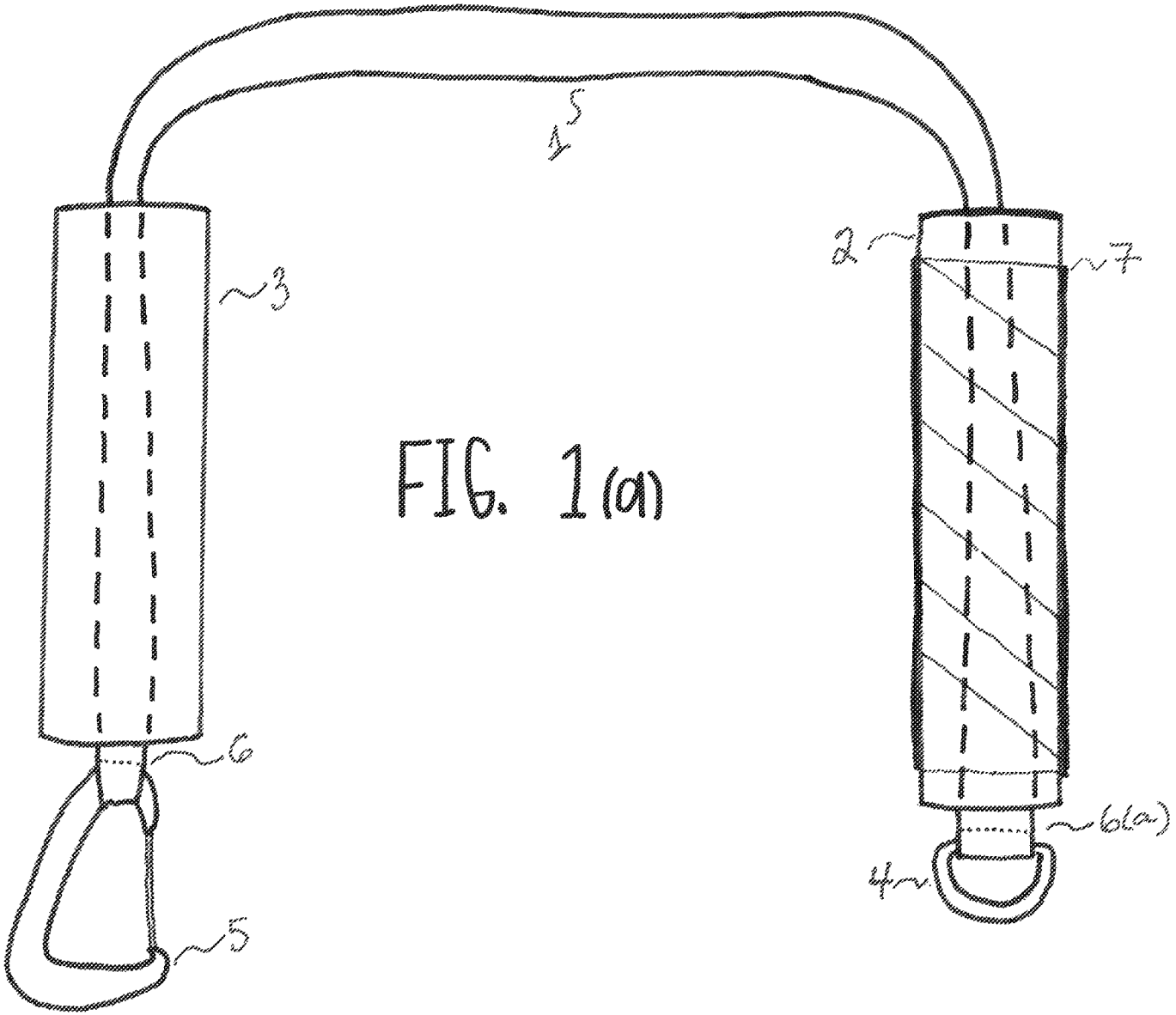
FIG. 1(*a*) illustrates an exemplary embodiment of the carrier system in the open position such that weight plates can be loaded onto the loading bar.
Figure 1A:
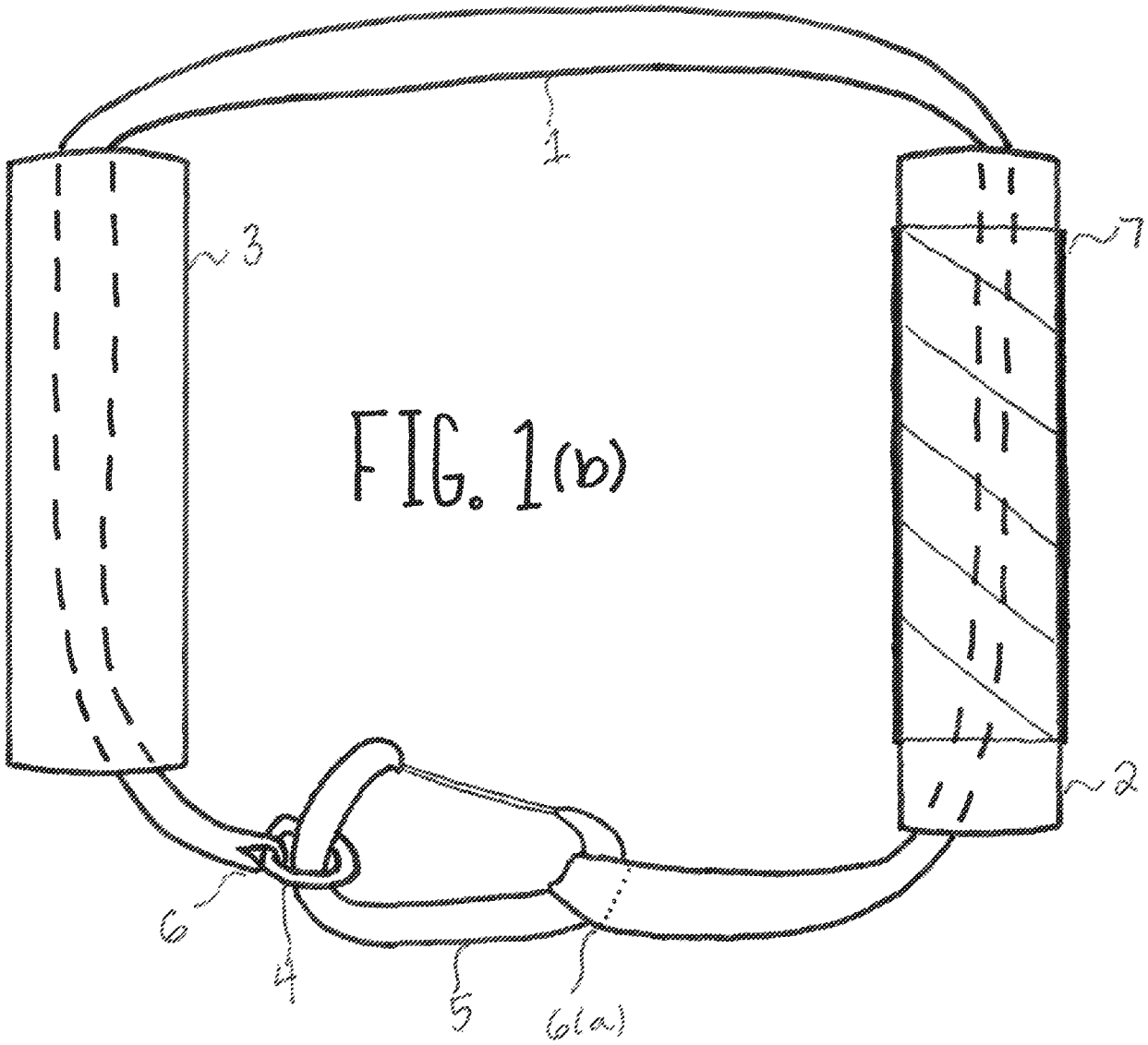

FIG. 1 illustrates an exemplary embodiment of a carrier system. The carrier system may include a strap (1), a carrying handle (2), and a loading bar (3). The strap may be threaded axially through the length of the inner opening of each of the carrying handle and the loading bar. The strap may have a first end and a second end, and may be terminated on each end with a fastener. In one embodiment, the strap may be terminated on a first end with a ring (4) and terminated on a second end with a clip or carabiner (5). The strap may have a fabric loop (6, 6*a*) at each end to connect to the fastener. In another embodiment, the strap may be terminated on a first end with a fabric loop and terminated on a second end with a clip or carabiner. In another embodiment the strap may be terminated on a first end with an S-hook and terminated on a second end with a second S-hook, a ring, or a fabric loop. The fastener may be preferably selected to have a cross-sectional size that may be small enough to allow the fastener to pass through the center of a standard weight plate, but large enough that it cannot pass through the loading bar. In a preferred embodiment, the fastener may be a three inch long carabiner and a ring or D-ring.

As shown in FIG. 1(*a*), the system may be arranged with the fastener in a disconnected or "open" configuration. In FIG. 1(*b*), the system is depicted with the fastener in a connected or "closed" configuration.

Figure 2:
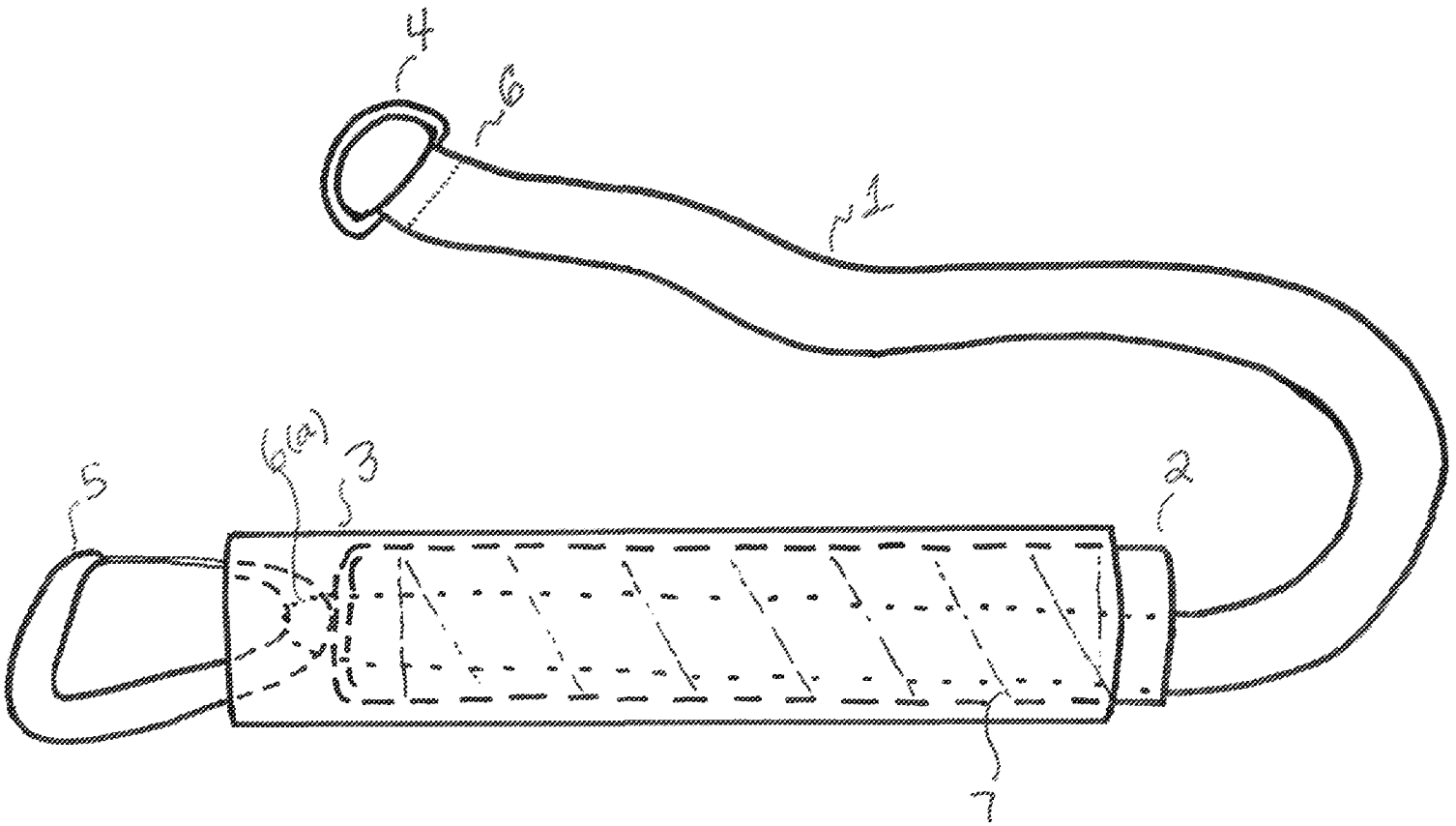
FIG. 2 illustrates an exemplary embodiment of the carrier system in which the carrying handle is disposed axially within the inner diameter of the loading bar.

The carrying handle (2) and the loading bar (3) may be tubular structures, and may be slidably disposed on the strap (1). The strap may be threaded axially through the length of the inner opening of each of the carrying handle and the loading bar. The diameters of the tubular members may be preferably selected such that the carrying handle (2) has an outer diameter that may be smaller than the inner diameter for the loading bar (3). This allows the carrying handle to be slidably disposed within the loading bar for compact storage of the carrier system. FIG. 2 illustrates the carrying handle disposed within the loading bar, and the strap threaded through the inner opening of the carrying handle. The configuration illustrated in FIG. 2 may be utilized when the system is stored.

The carrying handle and the loading bar each may be constructed of a strong but lightweight plastic, such as polyvinylchloride (PVC), polyethylene terephthalate (PET), acrylonitrile butadiene styrene (ABS), polycarbonate (PC), polydicyclopentadiene (pDCPD), polypropylene (PP), or the like. Alternatively, the carrying handle and the loading bar each may be constructed of metal, such as steel, stainless steel, cast iron, aluminum, titanium or the like. The carrying handle and the loading bar need not be made from the same material. Any combination of the foregoing materials is acceptable. For example, the carrying handle member may be constructed of PVC and the loading bar may be constructed of stainless steel. In a preferred embodiment, both the carrying handle and the loading bar may be constructed of PVC. In a second preferred embodiment, both the carrying handle and the loading bar may be constructed of stainless steel. In a third preferred embodiment, the carrying handle may be constructed of PVC and the loading bar may be constructed of cast iron or stainless steel.

The carrying handle may be coated with a soft coating (7) for comfort. For example, the carrying handle may be wrapped with grip tape or athletic tape, such as a fabric tape made of cotton, polyester, or a cotton-polyester blend, or silicone-based tape such as knurled silicone tape. Alternatively, the carrying handle may be coated with a softer grip material such as nitrile PVC (NPVC) foam, ethylene-propylene-diene monomer (EPDM) foam, neoprene, rubber, or silicone. The coating material may be smooth or may have a textured surface for reduced slippage. When the carrying handle is constructed of metal, the metal may have a knurled surface to provide a better gripping surface. The grip material may cover the entire outer surface of the handle member. Alternatively, the grip material may be affixed to a portion of the outer surface of the handle member, preferably the center portion of the handle member.

The carrying handle (2) may be preferably constructed as a hollow tube such that the strap (1) can be threaded axially through the length of the carrying handle. The carrying handle preferably may have an outer diameter of approximately 1 inch, or more preferably 1 and 5/16 inches. The carrying handle preferably may have an inner diameter of approximately 1 inch. When constructed of PVC, the thickness of the wall of the carrying handle (6) may be approximately 1/4 inch or more preferably about 3/16 inch. The carrying handle may be preferably about 9 inches long. In an alternative embodiment, the carrying handle may be about 8 inches long. In another alternative embodiment, the carrying handle may be about 7 inches long. In another alternative embodiment, the carrying handle may be about 6 inches long. In a preferred embodiment, the fastener may be selected to have a cross-section that is larger than the inner diameter of the carrying handle. This prevents the strap from inadvertently pulling through the carrying handle or becoming disconnected from the carrier system.

The loading bar may hold the weight plates when the system is in use. The loading bar (3) may be preferably constructed as a hollow tube such that the strap (1) and the carrying handle (2) can be threaded through the length of the loading bar (3). The loading bar may preferably have an outer diameter of approximately 2 inches, or more preferably, 1 and 15/16 inches. The loading bar preferably may have an inner diameter of about 1 inch, or more preferably at least 1 and 3/8 inches, or most preferably about 1 and 9/16 inches. When constructed of PVC, the thickness of the wall of the loading bar may be approximately 1/4 inch or more preferably about 3/16 inch. In a preferred embodiment, the fastener may be selected to have a cross-section that may be larger than the inner diameter of the loading bar. This may prevent the strap from inadvertently pulling through the loading bar or becoming disconnected from the carrier system.

Figure 3:
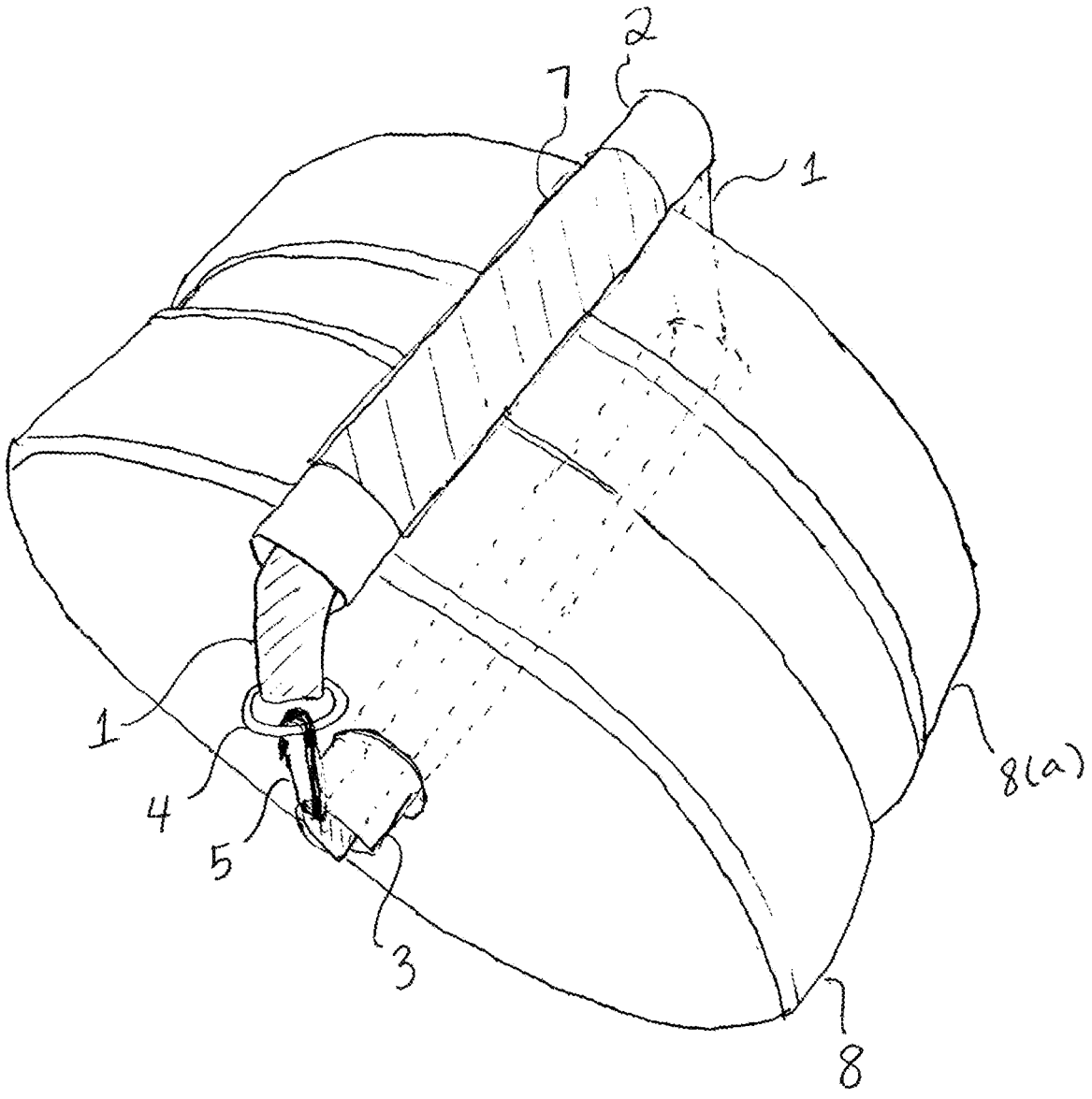
FIG. 3 illustrates the carrier system in the closed position and loaded with two 45 pound bumper plates on the loading bar.

The loading bar may be preferably about 9 inches long. In an alternative embodiment, the loading bar may be about 8 inches long. In another alternative embodiment, the loading bar may be about 7 inches long. In another alternative embodiment, the loading bar may be about 6 inches long. A tubular member that is 6 inches long may accommodate two standard 45 pound bumper plates (manufactured by, e.g., Rogue Fitness), allowing a user to carry up to 90 pounds in a single hand. A tubular member that is approximately 9 inches long may accommodate two standard 45 pound bumper plates as well as an additional 10 pound, 15 pound, 25 pound, or 45 pound bumper plate, allowing a user to carry up to 135 pounds in a single hand. Standard metal weight plates generally are thinner for the same weight, allowing even more weight to be loaded onto the loading bar. FIG. 3 illustrates the carrier system with two 45-pound bumper plates (8, 8(*a*)) loaded onto the loading bar (3). The loading bar (3) may fit through the center hole in the weight plates. The strap (1) may be disposed axially through the interior opening of the tubular loading bar (3). The strap (1) also may be disposed axially through the interior opening of the tubular carrying handle (2), and the fastener (4, 5) may be closed. In this configuration, when a user engages the carrying handle, the strap, loading bar, and weight plates also are engaged so that the user can carry the entire assembly.

In an embodiment, the loading bar can be removed from the system. In this embodiment, the loading bar may be removed and replaced with a different loading bar (e.g., a loading bar having a longer length to accommodate additional weight plates). The selection of the fastener attached to the strap may allow the loading bar to be removed at the user's option. For example, the user may remove a clip, carabiner, or S-hook from the second end of the strap (located proximal to the loading bar), and then slide the loading bar off of the strap.

The use of a rigid or semi-rigid loading bar may beneficially allow the weight plates to be loaded onto the carrier system with greater ease compared to the strap alone. Additionally, the use of a rigid or semi-rigid loading bar may ensure that the weight plates are carried at a consistent height from the ground. This avoids sagging or scraping the weights on the ground. Further, the loading bar may hold the weight plates at a consistent angle, which may prevent the weight plates from tipping when the carrier system is set down. This increases the safety of the system by avoiding situations in which the weight plates fall into the user's legs or onto the ground when the carrier system is set down.

In a particularly preferred embodiment, the carrying handle may be made of PVC and has an outer diameter of approximately 1 and 5/16 inches and a length of about 9 inches, and the loading bar may be made of PVC and has an outer diameter of approximately 1 and 15/16 inches, an inner diameter of about 1 and 9/16 inches, and a length of about 9 inches. In this embodiment, the strap may be approximately 36 inches in length and may be terminated on a first end with a fastener comprising a ring and terminated on the second end with a fastener comprising a clip or carabiner. Less preferably, when the carrying handle and the loading bar each have a length of about 9 inches, the strap may be approximately 35 inches, 34 inches, or 33 inches in length.

Through extensive testing, the inventor has determined that the carrier system provides optimal comfort to an adult user when the carrier handle and loading bar are each approximately 9 inches in length and the strap may be approximately 36 inches in length. This configuration allows easy loading of large bumper plates, provides optimal clearance for the user's grip, and generally prevents the bumper plates from contacting the ground or floor when the carrier system may be used in a farmer's carry position (i.e., with the user's arms extended at his or her side).

In a second particularly preferred embodiment, the carrying handle may be made of PVC and has an outer diameter of approximately 1 and 5/16 inches and a length of about 7 inches, and the loading bar may be made of PVC and has an outer diameter of approximately 1 and 15/16 inches, an inner diameter of about 1 and 9/16 inches, and a length of about 7 inches. In this embodiment, the strap may be approximately 36 inches in length and may be terminated on a first end with a fastener comprising a ring and terminated on the second end with a fastener comprising a clip or carabiner. In other embodiments, when the carrying handle and the loading bar each have a length of about 7 inches, the strap may be approximately 35 inches, 34 inches, 33 inches, 32 inches, 31 inches, or 30 inches in length.

The strap (1) may be threaded through the carrying handle (2) and the loading bar (3). The strap may be preferably made of nylon webbing, but may also be made from other strong and resilient fabrics. The strap could also be made of any rope material, including metal rope, synthetic rope, natural fiber rope, or flexible metal chain. Rope material optionally may be coated with plastic casing. The strap may be preferably about 36 inches long. In an alternative embodiment, the strap may be about 35 inches, 34 inches, 33 inches, 32 inches, 31 inches, 30 inches, 29 inches, 28 inches, 27 inches, 26 inches, 25 inches, 24 inches, 23 inches, 22 inches, 21 inches, or 20 inches. The length of the strap may be selected such that it leaves adequate space for the carrying handle to be grasped by a hand when standard weight plates have been loaded on the loading bar. For example, the diameter of a typical 45 pound bumper plate may be approximately 445 millimeters or 450 millimeters (i.e., about 17.5 inches to about 18 inches). The strap therefore must allow about 9 inches of clearance on each side of the tubular member. The fastener located on each end of the strap provides additional clearance space, the length of which varies depending on which fastener is selected.

Figure 4:
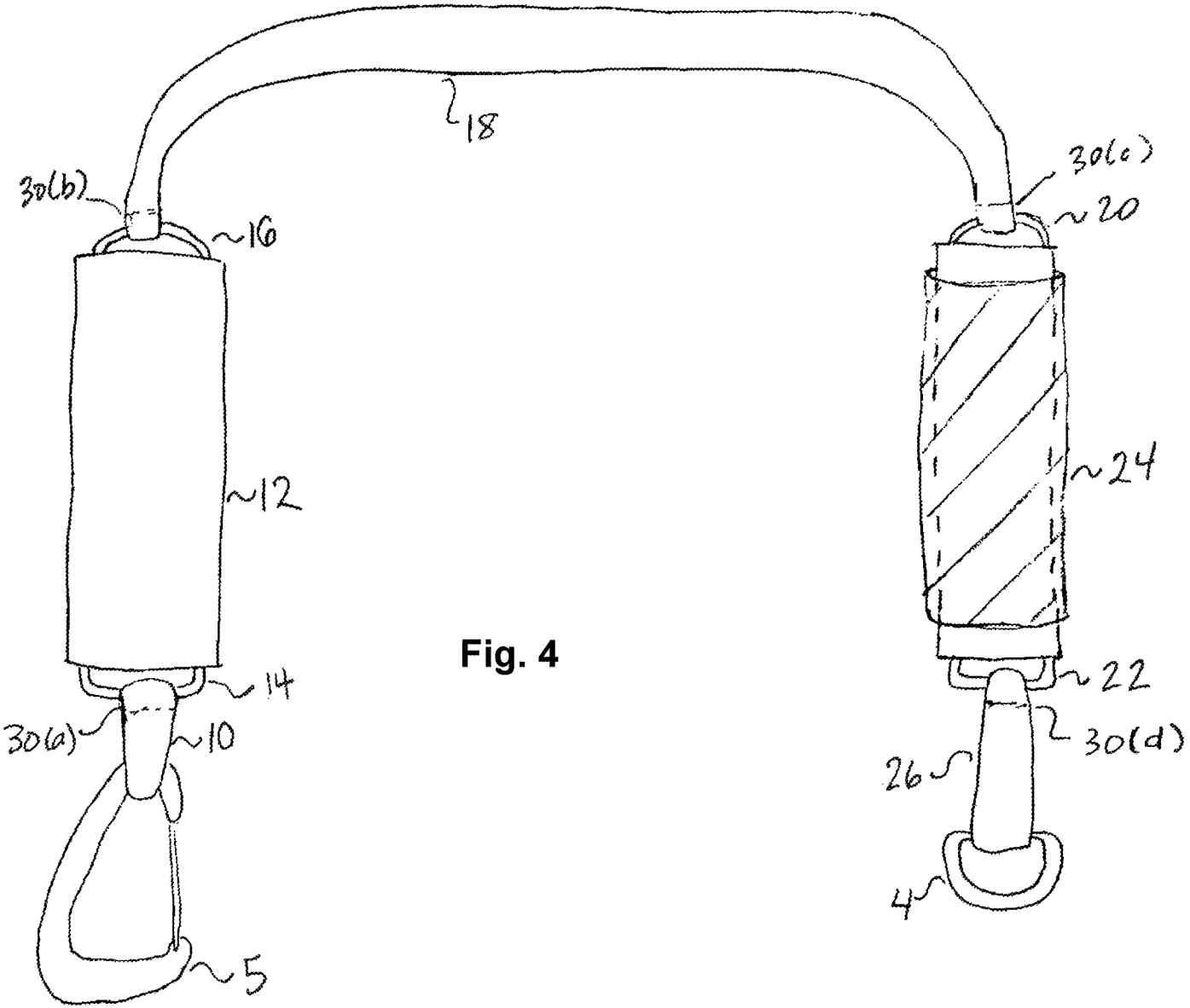
FIG. 4 illustrates an embodiment of the carrier system in which each end of the loading bar and the carrying handle is equipped with attachment means for a carrier strap. The carrier system is illustrated in the open position.

In an alternative embodiment illustrated in FIG. 4, the carrier system may be comprised of three straps (10, 18, 26), a handle member (32), and a loading member (12). The handle member (32) and the loading member (12) may each have a first end and a second end. Each of the first and second ends of the handle member and the loading member may have a connector (14, 16, 20, 22). In some embodiments, the connector may be a metal loop, buckle clip, or snap closure. In this embodiment, the handle member and the loading member may each independently may be a solid cylinder, a hollow cylinder with closed ends, or an open tube (i.e., a hollow cylinder with open ends).

A first strap (10) may be attached to the connector (14) on the first end of the loading member. The first end of the first strap (10) may be terminated in or attached to a fastener (5). For example, the fastener may be a carabiner, a clip, a ring, an S-hook, a fabric loop, or the like. As illustrated in FIG. 4, the first strap (10) may form a loop that attaches to the fastener, e.g., a carabiner (5). The first strap (10) may be attached at its second end to the attachment means (14) on the first end of the loading member. A fabric loop (30(*a*)) optionally may be utilized to secure the strap to the attachment means.

The attachment means (16) on the second end of the loading member may be attached to the first end of a second strap (18). The second strap (18) may be attached at its second end to the attachment means (20) on the first end of the handle member (32).

The handle member (32) serves as a handle when the system is in operation, and may be coated with a grip material (24). The grip material (24) on the handle member may be a wrapping of grip tape or athletic tape, such as a fabric tape made of cotton or polyester, or a silicon tape. Alternatively, the carrying handle may be coated with a softer grip material such as nitrile PVC (NPVC) foam, ethylene-propylene-diene monomer (EPDM) foam, neoprene, rubber, or silicone. The coating material may be smooth or may have a textured surface for reduced slippage. When the handle member is constructed of metal, the metal may have a knurled surface to provide a better gripping surface.

The attachment means (22) on the second end of the handle member may be attached to the third strap (26). The third strap may be attached at its first end to the handle member via the attachment means (22). A fabric loop (30(*d*)) optionally may be utilized to secure the strap to the attachment means. The second end of the third strap (26) may be terminated in or affixed to a fastener (4). The fastener may be a carabiner, a clip, a ring, an S-hook, a fabric loop, or the like. The fastener (4) attached to the third strap may be selected to be complementary to the fastener attached to the first strap, such that the two fastener operate together to allow the carrier system to be opened and closed to allow weight plates to be loaded onto, and unloaded from, the loading member. For example, the two fastener (4, 5) may be a pair of S-hooks; a carabiner and a ring; a carabiner and a fabric loop, or an S-hook and a fabric loop.

While the subject matter of this disclosure has been described and shown in considerable detail with reference to certain illustrative embodiments, including various combinations and sub-combinations of features, those skilled in the art will readily appreciate other embodiments and variations and modifications thereof as encompassed within the scope of the present disclosure. Moreover, the descriptions of such embodiments, combinations, and sub-combinations is not intended to convey that the claimed subject matter requires features or combinations of features other than those expressly recited in the claims. Accordingly, the scope of this disclosure is intended to include all modifications and variations encompassed within the spirit and scope of the following appended claims.

I claim:

1. A system for carrying weight plates, the system comprising:

a first tubular member, wherein the first tubular member is made of rigid material, a second tubular member, and a strap having a fixed length of approximately 20 inches to approximately 36 inches, wherein the strap is disposed axially through an interior of the first tubular member and the strap is disposed axially through an interior of the second tubular member, and wherein the strap has a first end and a second end, wherein the first end of the strap is terminated with a first fastener, and the second end is terminated with a second fastener, and wherein the first fastener and the second fastener are configured to releasably connect to each other such that the strap forms a single circular loop when the system is in a closed configuration.

2. The system of claim 1, wherein the first fastener comprises a clip.

3. The system of claim 2, wherein the second fastener comprises a ring or fabric loop.

4. The system of claim 3, wherein the second fastener is a ring, and said ring is disposed within a fabric loop at the second end of the strap.

5. The system of claim 2, wherein the clip is made of metal.

6. The system of claim 2, wherein the clip is disposed within a fabric loop at the first end of the strap.

7. The system of claim 1, wherein the outer diameter of the second tubular member is smaller than the inner diameter of the first tubular member.

8. The system of claim 7, wherein the second tubular member further comprises a soft grip material around at least a portion of its outer diameter, and wherein the first tubular member does not comprise a soft grip material.

9. The system of claim 8, wherein the soft grip material comprises fabric tape or silicone tape.

10. The system of claim 7, wherein the outer diameter of the first tubular member is approximately 1 and 15/16 inches to approximately 2 inches.

11. The system of claim 10, wherein the first tubular member has a wall thickness of approximately 3/16 inch to approximately 1/4 inch.

12. The system of claim 10, wherein the length of the first tubular member is approximately 6 inches to approximately 9 inches.

13. The system of claim 1, wherein the system is configured to support at least 90 pounds.

14. The system of claim 13, wherein the system is configured to support at least two 45 pound bumper plates.

15. The system of claim 1, wherein the first tubular member is made of polyvinyl chloride (PVC).

16. The system of claim 15, wherein the second tubular member is made of polyvinyl chloride (PVC).

17. The system of claim 1, wherein the second tubular member is made of a rigid material.

18. The system of claim 1, further comprising a weight plate disposed on the outer diameter of the first tubular member.

* * * * *